US007980815B2

(12) United States Patent
Cloarec

(10) Patent No.: US 7,980,815 B2
(45) Date of Patent: Jul. 19, 2011

(54) TURBOMACHINE VARIABLE-PITCH STATOR BLADE

(75) Inventor: Yvon Cloarec, Ecuelles (FR)

(73) Assignee: SNECMA, Paris (FR)

( * ) Notice: Subject to any disclaimer, the term of this patent is extended or adjusted under 35 U.S.C. 154(b) by 1138 days.

(21) Appl. No.: 11/697,455

(22) Filed: Apr. 6, 2007

(65) Prior Publication Data

US 2010/0266389 A1 Oct. 21, 2010

(30) Foreign Application Priority Data

Apr. 6, 2006 (FR) ..... 06 51243

(51) Int. Cl.
*F01D 17/12* (2006.01)

(52) U.S. Cl. ..... 415/148; 415/160

(58) Field of Classification Search ..... 415/148, 415/150, 151, 159, 160
See application file for complete search history.

(56) References Cited

U.S. PATENT DOCUMENTS

| | | | | |
|---|---|---|---|---|
| 2,671,634 A | | 3/1954 | Morley | |
| 3,542,484 A | | 11/1970 | Mason | |
| 4,498,790 A | * | 2/1985 | Fisher | 415/160 |
| 5,308,226 A | * | 5/1994 | Venkatasubbu et al. | 415/160 |
| 5,593,275 A | * | 1/1997 | Venkatasubbu et al. | 415/160 |
| 5,636,968 A | * | 6/1997 | Audet et al. | 415/160 |
| 5,807,072 A | * | 9/1998 | Payling | 415/170.1 |
| 6,129,512 A | * | 10/2000 | Agram et al. | 415/160 |
| 6,209,198 B1 | * | 4/2001 | Lammas et al. | 29/889.22 |
| 6,283,705 B1 | * | 9/2001 | Rice et al. | 415/160 |
| 6,843,638 B2 | * | 1/2005 | Hidalgo et al. | 415/209.3 |
| 7,220,098 B2 | * | 5/2007 | Bruce et al. | 415/160 |
| 2005/0084190 A1 | * | 4/2005 | Brooks et al. | 384/276 |

FOREIGN PATENT DOCUMENTS

| | | |
|---|---|---|
| EP | 0 546 935 A1 | 6/1993 |
| EP | 1 528 226 A2 | 5/2005 |

* cited by examiner

*Primary Examiner* — Igor Kershteyn
(74) *Attorney, Agent, or Firm* — Oblon, Spivak, McClelland, Maier & Neustadt, L.L.P.

(57) ABSTRACT

A turbomachine variable-pitch stator blade is disclosed. The stator blade includes an aerofoil, extended on one side by a pivot by which it is mounted so as to rotate in a bore of the casing of the turbomachine, and a plate, between the aerofoil and the pivot, perpendicular to the line formed by the aerofoil and the pivot. Since the face of the plate opposite to the aerofoil includes a first zone and a second zone, the first zone being subjected to an intense friction with the wall of the casing because of the transverse forces applied to the aerofoil, the thickness of the plate on the second zone is reduced relative to the thickness of the plate of the first zone. Therefore, it is possible to reduce the weight of the blade without loss of performance.

8 Claims, 2 Drawing Sheets

TURBOMACHINE VARIABLE-PITCH STATOR BLADE

BACKGROUND OF THE INVENTION

1. Field of the Invention

The present invention relates to the field of turbomachines such as an axial compressor of a gas turbine engine, and is particularly intended for the variable-pitch stator blades of the machine.

1. Description of the Related Art

An articulated system, such as the variable-pitch stator blades of a gas turbine engine compressor, comprises parts that move relative to one another. FIGS. 1 and 2 show schematically a variable-pitch stator blade 1 mounted in the casing 3 of the machine. The stator blade comprises an aerofoil 12, a plate or platform 13 and a rod forming a pivot 14 at one end. The pivot 14 is housed in a bore or radial orifice made in the wall of the casing 3 via various bearings. The blade is held by this end only. The other end holds an annular floating element 16 in which it is mounted so as to pivot via a second pivot 17. The ring is provided with sealing means for the portion of the rotor 18 that is adjacent to it. The pivot 14 swivels in the corresponding bore of the casing by means of bearings, for example a bottom bearing 4. The platform 13 is housed in a cavity in the form of a counterbore machined in the wall of this casing. The wall of the casing is in radial contact with the platform 13 either directly or by means of a bush or shim. The top portion of the pivot 14 is held in a top bearing 5. The opposite face of the platform 13 relative to the bearing 4 forms the base of the aerofoil and is swept by the gases set in motion by the compressor. This face of the plate is shaped so as to ensure the continuity of the stream formed by the casing. A nut holds the blade in its housing and a lever actuated by appropriate control members controls the rotation of the blade about the axis XX of the rod in order to place the latter in the required position relative to the line of the gaseous flow. The relative movements result from the sliding of the surfaces in contact with one another.

In the case of an axial compressor of a gas turbine engine or else an axial compressor only of air or another gas, such as a blast furnace or natural gas, the aerofoil 12 is subjected over the whole of its length to the aerodynamic and pressure forces generated by the gaseous flow. The component of these forces oriented perpendicularly to the chord in the pressure side to suction side direction, usually passing via the axis of the pivot, is the greatest. It is noted however that, in the case of major deflections, the component may move away from this axis. The aerofoil is also subjected to axial forces of static pressure directed upstream because of the pressure difference between downstream and upstream. The resultant force is illustrated by the arrow F in the figures. The result of this is the application of a moment that, associated with the rotation of pitch about the axis XX over an amplitude that may reach and exceed 40 degrees, creates an intense zone of friction. This friction leads secondarily to wear of the plate and/or the bushes. This first zone 20 of intense friction is located on a portion of the surface of the plate. It is indicated by crosses in FIG. 2. Therefore, in normal operation of the machine, because of these tilting forces applied to the aerofoil 12, the plate presses via this first zone 20 against the surface of the housing made in the wall of the casing, while on the portion diametrically opposed to the pivot, the pressing forces are zero or very slight.

In the aeronautical field, any excess weight should be avoided and independently of the excess pressure of any excess load, there is also an attempt to eliminate any weight that fulfils no function whether it be mechanical or aerodynamic.

The applicant also has the constant objective of finding solutions that make it possible to lighten the machine without, for all that, compromising its performance and its reliability. Any weight saving improves the efficiency of the machine and makes it possible to reduce operating costs.

BRIEF SUMMARY OF THE INVENTION

In pursuit of this objective, the applicant has therefore arrived at the present invention that relates to a variable-pitch stator blade.

According to the invention, the turbomachine variable-pitch stator blade comprising an aerofoil, extended on one side by a pivot by which it is mounted so as to rotate in a bore of the casing of the turbomachine, and a plate, between the aerofoil and the pivot, perpendicular to the line formed by the aerofoil and the pivot, is characterized in that, since the face of the plate opposite to the aerofoil comprises a first zone and a second zone, the first zone being subjected to an intense friction with the wall of the casing because of the transverse forces applied to the aerofoil and the second zone being subjected in normal operation to a less intense friction than the first zone, the thickness of the plate on the second zone is reduced relative to the thickness of the plate on the first zone.

Variable-pitch blades, particularly of an axial compressor, of the prior art have a plate of uniform thickness if no account is taken of the curvature and/or non-linearity of the gas stream. So, thanks to the invention, it is possible to reduce the weight of this portion of the blade without compromising its functionality, namely ensuring the continuity of the stream and reducing leakages along the pivot.

The second thinner zone extends practically over an arc of 60 to 120 degrees about the axis of the pivot.

For an axial compressor, the first zone is situated on the suction side and the second zone extends from the pressure side of the aerofoil.

Preferably, the second thinner zone is delimited by a border—in particular the upper face of this border is in the extension of the flat top surface of the plate—that is thicker than the first zone so as to form a decompression chamber between the periphery of the plate and the pivot which makes it possible to improve the seal. In addition, this border makes it possible to form a contact in the case where the forces are reversed, particularly when compressor pumping phenomena occur. In addition, this arrangement is advantageous when it comes to assembling the machine as it prevents the parts from tilting exaggeratedly.

A simple and economic means of producing blades with a second zone arranged in this way is to machine the plate. Depending on the tool chosen, the cavity has a bottom that is flat, curved or else any other shape.

BRIEF DESCRIPTION OF THE DRAWINGS

Other features and advantages will emerge from the following description of a non-limiting embodiment of the invention with reference to the drawings in which.

DETAILED DESCRIPTION OF THE INVENTION

Figure 1:
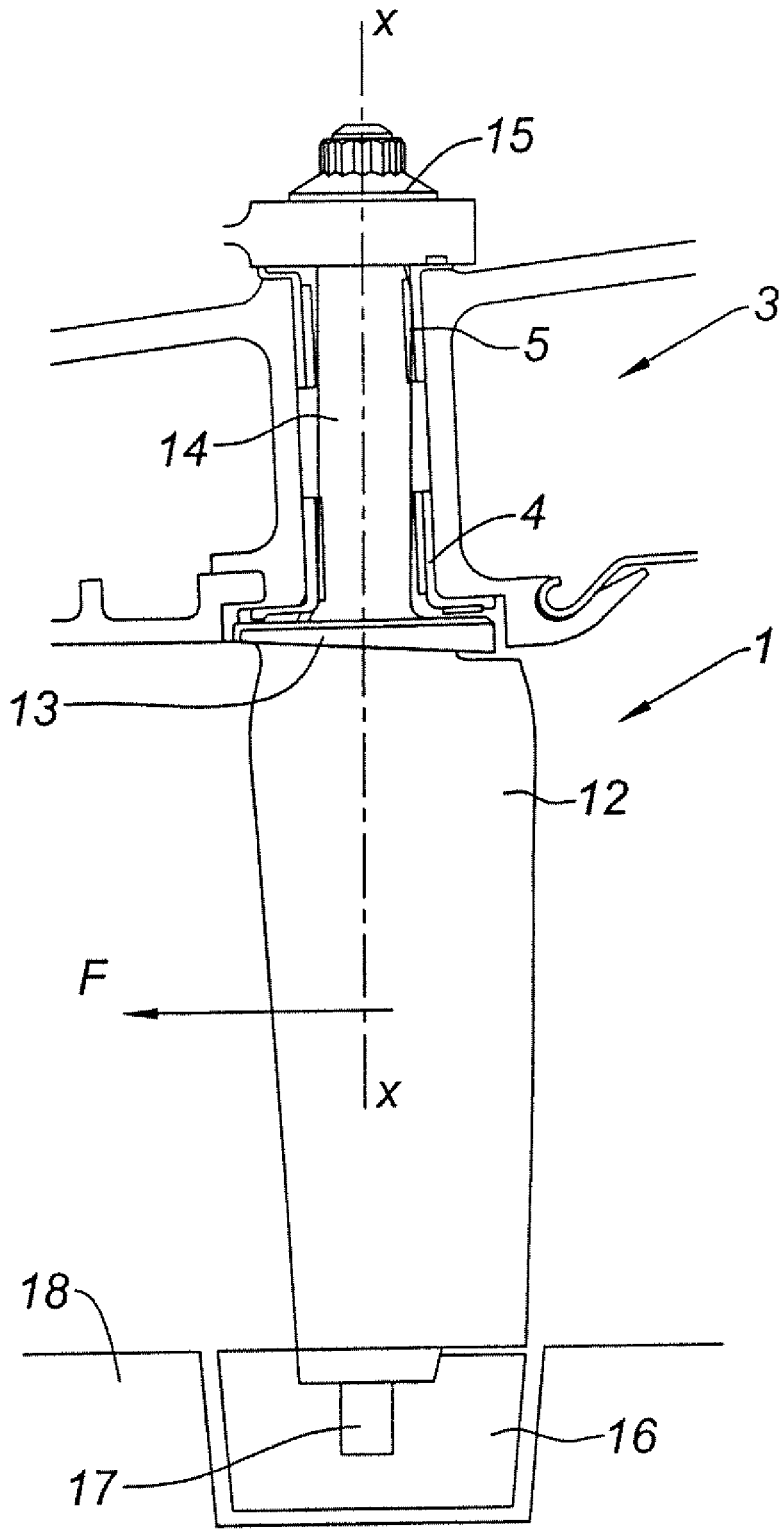
FIG. 1 shows, in section along the axis of the machine, an example of a conventional variable-pitch stator blade mounted in a compressor casing.
Figure 2:
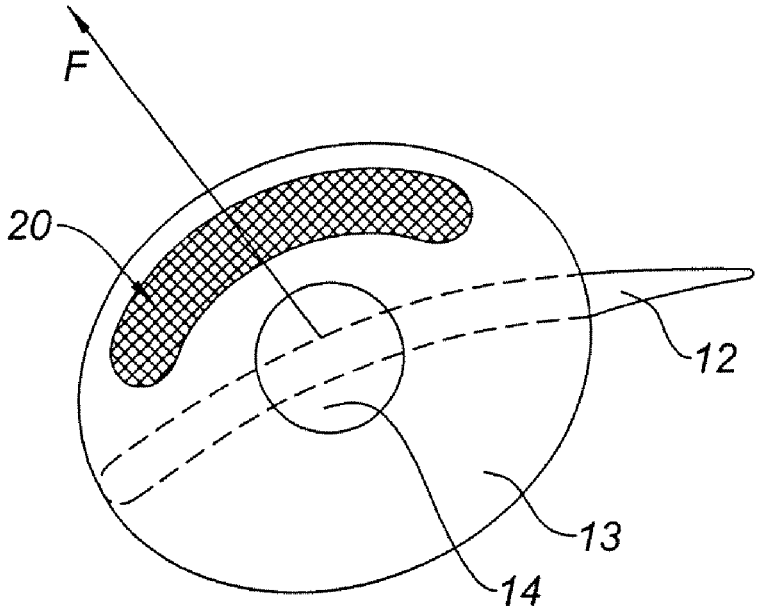
FIG. 2 shows the same blade seen from above.
Figure 3:
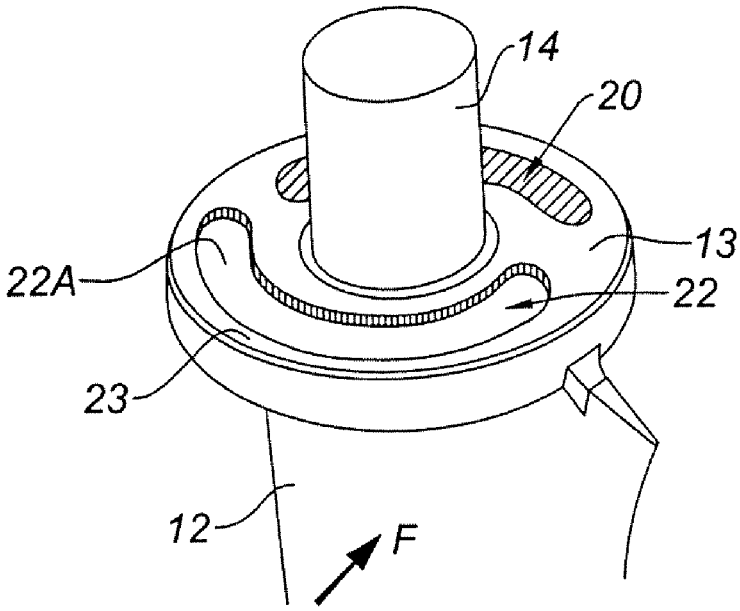
FIG. 3 is a view in perspective of a blade portion having the features of the invention.

FIG. 3 shows a stator blade on its own in its portion close to the pivot 14. The plate 13 is seen from above in perspective. According to one embodiment of the invention, machining has been carried out on the face of the plate turned towards the casing 3 to make a cavity 22A in the second zone 22 that is not subjected to the compression forces resulting from the application of the force F on the aerofoil 12. This cavity 22A here has been machined by means known per se. The bottom of the cavity is flat; it could be curved if the machining head were ball-shaped. Shapes other than that shown are possible. In addition, instead of machining, the cavity may originate from casting, forging or powder metallurgy. The cavity preferably extends over an arc, of a circle for example, of 60 to 120 degrees, advantageously corresponding to the arc subtending the zone of intense friction. The function of this cavity is to reduce the weight of the blade but not reduce its mechanical characteristics. The resulting thickness of the plate is therefore sufficient to ensure the mechanical strength of the plate. It can be seen that a border 23 has been retained on the periphery of the plate. This border has a dual function. The first is to form a decompression chamber reducing the air leakages between the stream of the turbomachine and the pivot 14 through the bore of the casing in which the pivot 14 is housed. The second function is to form a bearing surface in the case of reversal of the forces resulting from an operating anomaly of the turbomachine, such as the pumping of the compressor, or else to simplify the assembling operations. The width of this border need not be constant. For example, it could be wider in a zone to be reinforced. Advantageously, its upper plane is in the plane of the plate facing the casing.

A solution has been described in which the thickness is reduced on the upper face of the plate. However, it is also a part of the invention to carry out this thickness reduction by forming a cavity in the face of the plate situated on the side of the gas stream or by thinning the plate via this face.

The invention claimed is:

1. A turbomachine variable-pitch stator blade comprising:

an aerofoil, extended on one side by a pivot which is mounted so as to rotate in a bore of a casing of the turbomachine; and a plate disposed between the aerofoil and the pivot and perpendicular to a line formed by the aerofoil and the pivot, wherein a face of the plate opposite to the aerofoil includes a first zone and a second zone, the first zone being subjected to friction with the wall of the casing due to transverse forces applied to the aerofoil, the thickness of the plate on the second zone is reduced relative to the thickness of the plate of the first zone, and wherein the second thinner zone includes a cavity provided in the plate.

2. The blade according to claim 1, wherein the thinner portion of the second zone extends over an arc of 60 to 120 degrees about the pivot.

3. The blade according to claim 1, wherein the first zone is situated on the suction side and the second zone extends from the pressure side of the aerofoil.

4. The blade according to claim 1, wherein the cavity has a flat or curved bottom.

5. The blade according to claim 1 , wherein the cavity is elongate in an arc of a circle.

6. A turbomachine comprising at least one stator blade according to claim 1.

7. The blade according to claim 1, wherein the second thinner zone includes a border provided on a periphery of the plate.

8. A turbomachine variable-pitch stator blade comprising:

an aerofoil, extended on one side by a pivot which is mounted so as to rotate in a bore of a casing of the turbomachine; and a plate disposed between the aerofoil and the pivot and perpendicular to a line formed by the aerofoil and the pivot, wherein a face of the plate opposite to the aerofoil includes a first zone and a second zone, the first zone being subjected to friction with the wall of the casing due to transverse forces applied to the aerofoil, the thickness of the plate on the second zone is reduced relative to the thickness of the plate of the first zone, and wherein the second thinner zone is delimited by a border so as to form a decompression chamber between the periphery of the plate and the pivot.

* * * * *